United States Patent [19]

Roberts

[11] 4,021,271

[45] May 3, 1977

[54] ULTRAFINE GRAIN AL-MG ALLOY PRODUCT

[75] Inventor: Sidney G. Roberts, Livermore, Calif.

[73] Assignee: Kaiser Aluminum & Chemical Corporation, Oakland, Calif.

[22] Filed: July 7, 1975

[21] Appl. No.: 593,898

[52] U.S. Cl. ..... 148/2; 75/141; 75/142; 75/146; 75/147; 148/11.5 A; 148/32

[51] Int. Cl.[2] ..... C22F 1/04

[58] Field of Search ..... 75/147, 146, 141, 142; 148/2, 11.5 A, 12.7 A, 32, 32.5

[56] References Cited

UNITED STATES PATENTS

| | | | |
|---|---|---|---|
| 1,932,838 | 10/1933 | Dean et al. | 75/147 |
| 2,184,693 | 12/1939 | Beck et al. | 75/147 |
| 3,807,969 | 4/1974 | Schoerner et al. | 148/11.5 A |

*Primary Examiner*—R. Dean

*Attorney, Agent, or Firm*—Paul E. Calrow; Edward J. Lynch

[57] ABSTRACT

This invention is directed to an Al-Mg alloy product containing about 0.75–5% aluminide forming transition elements, such as iron, cobalt and nickel. After cold working, the alloy product readily recrystallizes at elevated temperatures to an average grain size less than 15 microns, usually 11 microns or less to provide high mechanical properties and a degree of superplasticity.

16 Claims, No Drawings

ULTRAFINE GRAIN AL-MG ALLOY PRODUCT

BACKGROUND OF THE INVENTION

This invention relates to an Al-Mg type alloy characterized by an extremely fine grain size and outstanding strength in the fully recrystallized or dead soft condition.

The Al-Mg alloy system is well known to provide excellent strength, corrosion resistance and fracture toughness. In the fully annealed or dead soft condition, the yield strengths of the alloys of this system increase with increased Mg content, reaching about 138 MPa (20 ksi) in alloys containing about 5% Mg. Further magnesium additions provide slightly higher yield strengths, but such alloys are difficult to process and often exhibit a pronounced susceptibility to stress corrosion cracking. As a result, in the past when yield strengths above 138 MPa (20 ksi) are desired, it has been necessary to produce the Al-Mg alloy materials in a partially annealed condition, at a significant sacrifice in ductility and thermal stability.

The post-casting processing procedures for the commercially produced Al-Mg alloys are closely controlled to obtain a small uniform grain structure in the final material. However, under the best of commercial fabricating practices, the average grain size for the Al-Mg type alloy products will usually be ASTM No. 8 or larger as determined by ASTM Standard No. E112-63, which is equivalent to an average grain diameter of about 20 microns. Even under laboratory conditions, an average grain size of less than ASTM No. 9, indicating an average grain diameter smaller than 16 microns, has heretofore been very difficult to obtain for most aluminum alloys.

It is well recognized that a finer grain size generally provides a higher yield strength in a fully annealed product and, moreover, an ultrafine grain size may also indicate that the materials has some degree of superplasticity.

It is against this background that the present invention was developed.

DESCRIPTION OF THE INVENTION

This invention generally relates to an Al-Mg type alloy containing significant amounts of second phase forming elements, such as iron, cobalt and nickel. The alloy when fully annealed from a highly worked condition is characterized by an extremely fine recrystallized grain structure which provides outstanding yield strength, coupled with excellent elongation, and a degree of superplasticity. As used herein, all references to percent composition mean weight percent unless noted otherwise.

In accordance with the invention, an Al-Mg alloy is prepared containing at least 0.75% total of transition elements, such as iron, nickel or cobalt, and then cast in a manner which maintains substantially all of the second phase aluminide particles formed during the solidification of the alloy, e.g., iron aluminide, cobalt aluminide or nickel aluminide, less than 5 microns in maximum dimension. The dendrite arm spacing of the solidified product is generally less than 75 microns. After casting, the ingot is worked in a suitable manner, such as by cold working or hot working, then cold working, to impart a residual level of cold work equivalent to that obtained by a thickness reduction of at least 50% by cold rolling. Upon annealing, the cold work structure readily recrystallizes to form an ultrafine grained structure with the average grain size less than 15 microns, usually 11 microns or less (ASTM grain size No. 10).

The alloy of the invention generally consists essentially of from about 2.0 to about 9.0% magnesium, from about 0.75 to about 5% total of one or more transition elements selected from the group consisting of iron, cobalt and nickel and the balance aluminum and inconsequential amounts of other elements. Preferably, the magnesium content ranges from about 2–5% and the total transition element content from about 1–3%. The weight ratio of magnesium to total transition elements should exceed 2:1. Moreover, at least 1% magnesium should exist as a solute in the aluminum matrix and there should be at least 2% of a second phase transition element aluminide in order to obtain the ultrafine grained structure.

The alloy can contain other elements as impurities or positive additions provided such elements do not detrimentally affect the basic properties of the invention. Such elements include up to 5% zinc, up to 1% manganese, up to 0.5% chromium, up to 2.0% copper, up to 0.2% titanium, up to 1.0% silicon, up to 0.10% beryllium, can be added to the alloy of the invention. However, such alloying elements should be present only in amounts sufficient to provide the particular desired property for which the alloying constituent is being added or controlled, and should not be present in quantities which form intermetallic compounds with the transition elements or magnesium to the extent that such additions are detrimental to the formation of ultrafine grain size upon annealing. For many applications, the total alloying constituents other than magnesium and transition elements should be maintained less than 1%, preferably less than 0.5% total.

The alloy of the invention is cast with a relatively high solidification rate so as to maintain substantially all of the second phase particles precipitated during solidification at less than 5 microns in maximum dimension and a dendrite arm spacing generally of less than 75 microns. Direct chill (DC) continuous casting or other casting methods, including powder metallurgical techniques, may be used provided the above requirements are met. Because the freezing rate of an ingot depends upon its thickness, method of cooling, alloy composition and casting rate, these factors must be controlled and adjusted in a well-known manner to obtain the required structure. Usually, to obtain the requisite solidification rate, the ingot thickness will be less than 10 inches. Homogenization of the cast ingot prior to rolling is usually not required, although such thermal treatments may be employed if desired. Homogenization treatment conditions should be selected to avoid significant agglomeration of the second phase aluminide particles. For example, a suitable homogenization treatment would consist of heating to the temperature range of 427° to 593° C for times of 1–48 hours.

Although the procedures and conditions for hot rolling or breakdown of the ingot are not critical for obtaining an ultrafine grained product, preferably, the ingot is initially hot rolled at a temperature of about 315°–482° C to an intermediate gauge, then cold rolled to the desired thickness. If desired, the hot rolling can be followed by an anneal or by warm rolling at about 121°–315° C before the product is cold rolled to the desired thickness. Both hot rolling and warm rolling may impart some work hardening to the ingot so there is no critical amount of actual cold reduction necessary. However, in order for the ultrafine recrystallized grain structure of the invention to be generated, it is required that prior to the recrystallization anneal, the aluminum matrix contain a relatively high level of work hardening from deformation. Prior to the recrystallization anneal, the product should have a degree of work hardening at least equivalent to that obtained by a 50% thickness reduction by cold rolling. The yield strength of a work material is a good indication of the amount of work hardening present and after appropriate amounts of cold working, the product of the invention will have a yield strength greater than 207 MPa (30 ksi) and usually greater than 241 MPa (35 ksi). Typical yield strengths range from about 325–486 MPa (40–60 ksi). Generally, the amount of residual cold work required is related inversely to the amount of magnesium as solute, i.e., the lower the amount of Mg as solute, the more cold work necessary.

After imparting the requisite amount of cold work to the product, it is annealed at a temperature between about 200°–538° C, preferably about 232°–343° C. During annealing, the worked material readily recrystallizes to an average grain size less than 15 microns, usually 11 microns or less.

It is well recognized that grain growth can occur at elevated temperature and that the grain size developed is dependent on both time and temperature. Therefore, to prevent significant grain growth during the final anneal, it is desirable to hold product at annealing temperature for the minimum time required to achieve the desired recrystallized structure. When well recognized precautions such as these are observed, the average grain size of the material will be 11 microns or less in diameter. Satisfactory annealing temperatures can range from 200°–538° C, while the times at temperature can range from a fraction of a second for a high temperature continuous anneal up to and exceeding 24 hours for low or moderate temperature batch annealing.

In the cold worked product of the invention, a majority of the second phase aluminide particles are less than 3 microns in maximum dimension due to the reduction of the second phase particles during working. The fine second phase aluminide dispersoid in the product of the invention provides a multitude of matrix-particle interfaces which are effective nucleation sites for recrystallization during annealing provided sufficient cold work has been imparted to the cast material prior to annealing. An abundance of particle-to-particle separations of 1 micron or larger exists, which permits the development and growth of the recrystallization nuclei during annealing. As a result of the combined effects of this dispersoid and the highly cold worked Al-Mg alloy matrix, the product of the invention readily recrystallizes upon heating to yield an extremely fine grained product with an average grain diameter of less than 15 microns, usually less than 11 microns. At least 1% by weight magnesium as solute must exist (at room temperature) to develop the requisite highly worked structure.

In the fully annealed or dead soft condition, the products of the invention at low magnesium levels (2%–3%) exhibit yield strengths in excess of 96 MPa (14 ksi), at intermediate magnesium levels (3–5%) exhibit yield strengths in excess of 148 MPa (20 ksi) at high magnesium levels (5%–9%) exhibit yield strengths in excess of 159 MPa (23 ksi). Heretofore, at a given magnesium level, the yield strengths obtained with the products of the invention have been unattainable in dead soft Al-Mg alloy products. Elongation in the fully annealed condition normally exceeds 20% in 2 inches. Furthermore, the sheet products of the invention at a thickness of about 0.035 inch have Olsen cup depth values of about 0.40 inch and can be subjected to 180° OT bends in both the longitudinal and transverse directions without detrimental surface effects. The fine grained structure of the invention also provides complete freedom from orange peel or surface roughening when such sheet products are subsequently shaped or otherwise fabricated. The product also has a degree of superplasticity. For example, at 315° C, sheet products of the invention exhibit elongations 60% greater than similar products at equivalent magnesium levels.

The following examples are provided to further illustrate the invention.

EXAMPLE I

An aluminum alloy was prepared containing 1.7% iron and 3.5% magnesium, DC cast into a 76 mm × 228 mm ingot at a casting speed of 60.9 cm/min. The solidification rate was sufficiently rapid to maintain a majority of the iron aluminide second phase particles at less than 3 microns in maximum dimension and to control the dendrite arm spacing to about 30–60 microns. The cast ingot was heated to a hot rolling temperature of 425° C, hot rolled directly to about 3 mm thickness and then cold rolled to a final gauge of 0.9 mm. After rolling, the dimensions of the largest aluminide particles were about 2–3 microns in maximum dimension. The material, which had approximately a 70% reduction by cold rolling, exhibited a yield strength of about 379 MPa (55 ksi). Upon heating for 15 minutes at 310° C, the sheet product readily recrystallized to yield an extremely fine grained product. The average grain size in this sheet was about ASTM No. 11½, indicating an average grain diameter of about 7 microns. The properties of the recrystallized, fully annealed sheet are set forth below.

| Direction | TS MPa (ksi) | YS MPa (ksi) | % Elong. (50.8 mm) |
|---|---|---|---|
| Long. | 300 (43.5) | 171 (24.8) | 22.0 |
| 45° | 299 (43.4) | 174 (25.2) | 23.5 |
| Trans. | 299 (43.4) | 175 (25.4) | 22.2 |
| Additional Data: | Olsen cup depth = 10.16 mm (0.40-in.); r = −0.19; Earing = 3% at 45°; 180° bend = OT | | |

EXAMPLE II

Another aluminum alloy was prepared containing 0.75% iron, 0.75% cobalt and about 3.7% magnesium, DC cast into a 76 mm × 228 mm ingot at a casting speed of about 60.9 cm/min. The solidification rate was sufficiently rapid to control the majority of the iron aluminide and cobalt aluminide second phase particles to less than 3 microns in maximum dimension and to control the dendrite arm spacing to about 30–60 microns. The ingot was heated to a hot rolling temperature of 425° C, hot rolled directly to about 3 mm thickness and then cold rolled to a final gauge of 0.9 mm. After rolling, the dimension of the largest aluminide particles was about 2–3 microns. The material, which had approximately a 70% reduction in thickness by cold rolling, exhibited a yield strength of 385 MPa (55.8 ksi). Upon heating for 4 hours at 288° C, the sheet readily recrystallized to yield an extremely fine grain product with the average grain size that was slightly smaller than ASTM No. 10 (an average grain diameter of 11 microns or less). The properties of the recrystallized sheet are set forth below.

| Direction | TS MPa (ksi) | YS MPa (ksi) | % Elong. (50.8 mm) |
|---|---|---|---|
| Long. | 279 (40.5) | 148 (21.5) | 21.5 |
| Trans. | 273 (39.6) | 147 (21.4) | 24.0 |
| Additional Data: | Olsen cup depth = 10.07 mm (0.38 in.); 180° Bend = OT | | |

As is evident by the above example, cobalt additions may be substituted in full or in part on an equal weight basis with iron additions. Nickel has been found to be fully equivalent in this regard and generally all three of the transition elements, iron, nickel and cobalt, can be interchanged freely on an equal weight basis.

It is obvious that various modifications and improvements can be made to the invention without departing from the spirit thereof and the scope of the appended claims.

What is claimed is:

1. A wrought Al-Mg alloy product which has a residual level of cold work equivalent to at least a 50% reduction in the thickness by cold rolling and which readily recrystallizes at elevated temperatures consisting essentially of from about 2 to 9% of magnesium, from about 0.75 to 5% total of aluminide forming transition elements selected from the group consisting of iron, cobalt, nickel and combinations thereof and the balance aluminum and inconsequential amounts of other elements, the weight ratio of magnesium to the total of the transition elements being greater than 2 to 1, at least 1% magnesium existing as solute in the aluminum matrix, the total transition element aluminide being greater than 2% and substantially all of the second phase transition element aluminide particles being less than 5 microns in maximum dimension.

2. The product of claim 1 wherein substantially all the dendrite arm spacings are less than 75 microns.

3. The product of claim 1 wherein the level of cold work is equivalent to at least a 70% thickness reduction by cold rolling.

4. A Al-Mg alloy product which has been worked an amount equivalent to at least a 50% reduction in thickness by cold rolling and then recrystallized consisting essentially of from about 2 to 9% of magnesium, from about 0.75 to 5.0% total of aluminide forming transition elements selected from the group consisting of iron, cobalt, nickel and combinations thereof and the balance aluminum and inconsequential amounts of other elements, the weight ratio of magnesium to the total of the transition elements being greater than 2 to 1, at least 1% magnesium existing as solute in the aluminum matrix, the total transition element aluminide being greater than 2% and substantially all of the second phase transition element aluminide particles being less than 5 microns in maximum dimension, said product characterized by an average grain size less than 15 microns in maximum dimension.

5. A method of forming an ultrafine grained Al-Mg alloy product comprising:

a. casting an aluminum alloy consisting essentially of from about 2 to 9% by weight of magnesium, from about 0.75 to 5.0% total of aluminide forming transition elements selected from the group consisting of iron, nickel, cobalt and combinations thereof and the balance aluminum and inconsequential amounts of other elements, the weight ratio of magnesium to the total of the transition elements being greater than 2 to 1, the total aluminide content being greater than 2% and at least 1% magnesium existing as solute in the aluminum matrix, said casting conducted so that substantially all of the second phase transition element aluminide particles which form during casting do not exceed 5 microns in maximum dimension, and substantially all of the dendrite arm spacings are less than 75 microns, b. working said cast alloy so as to impart thereto a level of cold work equivalent to at least a 50% thickness reduction by cold rolling, and c. annealing said worked alloy at a temperature in excess of 200° C for sufficient time to recrystallize said worked alloy to form an average grain size less than 15 microns in maximum dimension.

6. The method of claim 5 wherein the worked alloy is annealed at a temperature about 232°–343° C.

7. The annealed product of claim 4 wherein the average grain size is equal to or less than 11 microns.

8. The method of claim 5 wherein said cast alloy is worked by cold rolling.

9. The method of claim 5 wherein said cast alloy is worked by first hot rolling, then cold rolling.

10. The method of claim 5 wherein said cast alloy is worked by hot rolling, by warm rolling and then by cold rolling.

11. The product of claim 1 containing one or more elements selected from the group consisting of up to 5% zinc, up to 1% manganese, up to 0.2% chromium, up to 2.0% copper, up to 0.2% titanium, up to 1.0% silicon and up to 0.1% beryllium.

12. The product of claim 1 containing about 2–5% magnesium and 1–3% total transition elements.

13. The product of claim 4 containing one or more elements selected from the group consisting of up to 5% zinc, up to 1% manganese, up to 0.2% chromium, up to 2.0% copper, up to 0.2% titanium, up to 1.0% silicon and up to 0.1% beryllium.

14. The product of claim 4 containing about 2–5% magnesium and 1–3% total transition elements.

15. The method of claim 5 wherein the aluminum alloy contains one or more elements selected from the group consisting of up to 5% zinc, up to 1% manganese, up to 0.2% chromium, up to 2.0% copper, up to 0.2% titanium, up to 1.0% silicon and up to 0.1% beryllium.

16. The method of claim 5 wherein the aluminum alloy contains about 2–5% magnesium and 1–3% total transition elements.

* * * * *